US009717639B2

(12) United States Patent
Kline et al.

(10) Patent No.: US 9,717,639 B2
(45) Date of Patent: Aug. 1, 2017

(54) ENHANCED BIOMECHANICAL STIMULATION DEVICE

(71) Applicants: Eric J. Kline, Twinsburg, OH (US); David Frahlich, Twinsburg, OH (US); Kevin Holle, Twinsburg, OH (US)

(72) Inventors: Eric J. Kline, Twinsburg, OH (US); David Frahlich, Twinsburg, OH (US); Kevin Holle, Twinsburg, OH (US)

(73) Assignee: STP Swiss Therapeutic Products AG (CH)

( * ) Notice: Subject to any disclaimer, the term of this patent is extended or adjusted under 35 U.S.C. 154(b) by 284 days.

(21) Appl. No.: 14/071,259

(22) Filed: Nov. 4, 2013

(65) Prior Publication Data

US 2014/0058298 A1 Feb. 27, 2014

Related U.S. Application Data

(63) Continuation of application No. 12/779,618, filed on May 13, 2010, now Pat. No. 8,574,179, which is a (Continued)

(51) Int. Cl.
*A61H 1/00* (2006.01)
*A61H 23/02* (2006.01)

(52) U.S. Cl.
CPC ..... *A61H 1/008* (2013.01); *A61H 23/0254* (2013.01); *A61H 2201/0157* (2013.01); (Continued)

(58) Field of Classification Search
CPC ..... A61H 23/00; A61H 23/0254; A61H 1/00; A61H 1/008; A61H 2201/0157; (Continued)

(56) References Cited

U.S. PATENT DOCUMENTS 1,837,531 A 12/1931 Cole
2,088,963 A 8/1937 Kondo
(Continued)

FOREIGN PATENT DOCUMENTS

DE 1766458 7/1971
DE 3212280 10/1983
(Continued)

OTHER PUBLICATIONS

English Translation for DE 4443756 C1.*
(Continued)

*Primary Examiner* — Quang D Thanh
(74) *Attorney, Agent, or Firm* — McDonald Hopkins LLC

(57) ABSTRACT

A biomechanical stimulation device is presented. The biomechanical stimulation device comprises a base that supports an adjustable height arm and an easily removable drum connected to the arm. The drum is driven by a motor to provide an elliptical stimulation motion. An anti-rotation device prevents rotation, but allows orbital translation of drum. The drum may connect to the arm at a single attachment point. The arm 20 may be pivotally attached to the base and selectively movable to a desired position. A pair of struts may support the arm to assist in positioning the arm. The struts may be locked to prevent movement of the arm, or unlocked by a release button to allow selective positioning of the arm. The biomechanical stimulation device may further include a hand controller and other peripheral devices to provides a convenient interface for controlling the speed and run time of the biomechanical stimulation device.

16 Claims, 15 Drawing Sheets

Related U.S. Application Data continuation-in-part of application No. 11/663,254, filed on Dec. 23, 2008, now abandoned.

(60) Provisional application No. 61/216,126, filed on May 13, 2009.

(52) U.S. Cl.
CPC ..... *A61H 2201/0192* (2013.01); *A61H 2201/1284* (2013.01); *A61H 2201/5007* (2013.01); *A61H 2201/5035* (2013.01); *A61H 2201/5038* (2013.01); *A61H 2201/5043* (2013.01)

(58) Field of Classification Search
CPC .... A61H 2201/0192; A61H 2201/1284; A61H 2201/5007; A61H 2201/5035; A61H 2201/5038; A61H 2201/5043
See application file for complete search history.

(56) References Cited

U.S. PATENT DOCUMENTS

| | | | | | |
|---|---|---|---|---|---|
| 2,256,534 | A | | 9/1941 | Tjaden | |
| 2,845,063 | A | | 7/1958 | Allen | |
| 3,547,109 | A | * | 12/1970 | Martin | A61H 1/00 601/65 |
| 3,984,101 | A | | 10/1976 | Garza | |
| 4,004,580 | A | | 1/1977 | Knobel | |
| 4,676,501 | A | | 6/1987 | Hoagland et al. | |
| 4,782,823 | A | | 11/1988 | Yamasaki | |
| 4,984,569 | A | | 1/1991 | Liu | |
| 5,236,318 | A | | 8/1993 | Richardson, Jr. | |
| 5,237,848 | A | | 8/1993 | Campbell | |
| 5,242,356 | A | * | 9/1993 | Grenfell | A61H 1/0292 482/142 |
| 5,290,211 | A | | 3/1994 | Stearns | |
| 5,520,614 | A | | 5/1996 | McNamara et al. | |
| 5,540,637 | A | | 7/1996 | Rodgers, Jr. | |
| 5,554,102 | A | | 9/1996 | Chiou | |
| 5,897,463 | A | | 4/1999 | Maresh | |
| 6,145,638 | A | * | 11/2000 | Popjoy | F16F 9/0245 188/269 |
| 2005/0033203 | A1 | * | 2/2005 | Son | A61H 1/005 601/98 |
| 2009/0037040 | A1 | * | 2/2009 | Salmon | B63B 17/00 701/21 |
| 2009/0124939 | A1 | | 5/2009 | Hansenberger et al. | |

FOREIGN PATENT DOCUMENTS

| | | | | |
|---|---|---|---|---|
| DE | 4443756 | | 2/1996 | |
| DE | 4443756 | C1 * | 2/1996 | A61H 23/02 |
| DE | 19517866 | | 6/1996 | |
| DE | 19944456 | | 3/2001 | |
| DE | 20116277 | | 11/2001 | |
| DE | 202118959 | | 3/2003 | |
| EP | 1537844 | | 6/2005 | |
| EP | 1555006 | | 7/2005 | |
| EP | 1637114 | | 3/2006 | |
| EP | 1637117 | | 3/2006 | |
| WO | 9501150 | | 1/1995 | |
| WO | 2005053594 | | 6/2005 | |
| WO | 2005067861 | | 7/2005 | |
| WO | 2007034531 | | 3/2007 | |

OTHER PUBLICATIONS

International Preliminary Report for International Application No. PCT/US2010/034761, dated Mar. 13, 2012.

International Search Report and Written Opinion for International Application No. PCT/US2010/034761, dated Aug. 19, 2010.

* cited by examiner

ENHANCED BIOMECHANICAL STIMULATION DEVICE

CROSS-REFERENCE TO RELATED APPLICATIONS

This application claims the benefit of priority to U.S. patent application Ser. No. 12/779,618 filed on May 13, 2010 (which is now US Pat. No. 8,574,179), which is a continuation-in-part of U.S. patent application Ser. No. 11/663,254 filed on Dec. 23, 2008 and claims priority to European Foreign Patent Application 04022121.0 filed on Sep. 17, 2004 and U.S. Provisional Patent Application Ser. No. 61/216,126 filed on May 13, 2009, each of which are hereby incorporated by reference in their entirety.

FIELD OF ART

The present invention is related to an improved device for biomechanical stimulation of muscles.

BACKGROUND

Biomechanical stimulation was first developed in the former USSR in the 1970's by Prof. Nazarov for the field of competitive sports. Biomechanical stimulation (BMS) is a means whereby a device, such as the present device, provides an elliptical mechanical stimulation motion at controlled frequencies or speeds and at controlled amplitudes. The elliptical motion of the biomechanical stimulator is then transferred to the muscle and/or the soft tissue of the human body by the elliptical motion of the stimulation drum.

The vibration therapy provided by biomechanical stimulation positively influences the muscles, soft tissue, circulation and lymphatic system of the human body. This mechanical stimulation provides a variety of anatomical and metabolic improvements or enhancements for the human body. These improvement and enhancements include, but not limited to, the warm-up of muscle groups before an athlete competes without expending energy to warm-up these muscle groups, increasing the range of motion when muscles have atrophied, and improved recovery of muscle groups for athletes after competition. For exercising or competing athletes, BMS aids improved recovery by stimulating or stretching muscle groups, and by increasing blood circulation that aids the body's recovery by carrying away waste products such as lactic acid. Recent studies indicate that sore muscles are the result of minute muscle fiber tears, biomechanical stimulation improves the recovery of these sore muscles caused by the tiny muscle tears following exercise. Again, by increasing the blood flow and oscillating the sore muscles with the elliptical stimulation motion of the biomechanical stimulation device, the muscles are able to recover faster thus helping the athlete prepare for peak performance in the next competition.

SUMMARY

A biomechanical stimulation device is presented. The biomechanical stimulation device comprises a base that supports an arm and a drum connected to the arm. The drum is driven by a motor to provide a stimulation motion, such as an orbital stimulation motion. The drum may connect to the arm at a single attachment point. The arm 20 may be pivotally attached to the base and selectively movable to a desired position. One or more struts may support the arm to assist in positioning the arm. The strut or struts may be locked to prevent movement of the arm, or unlocked by a release button to allow selective positioning of the arm.

BRIEF DESCRIPTION OF THE DRAWINGS

Objects and advantages together with the operation of the invention may be better understood by reference to the following detailed description taken in connection with the following illustrations, wherein.

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the present invention.

A device for providing biomechanical stimulation of various parts of the human anatomy is presented. The device may be used with body parts such as muscles and soft tissue for performance enhancement or rehabilitation purposes. The device enhances user interaction with the biomechanical stimulation device ("biomechanical stimulator") by providing additional options for biomechanical stimulation therapy and improved position adjustment options.

Figure 1:
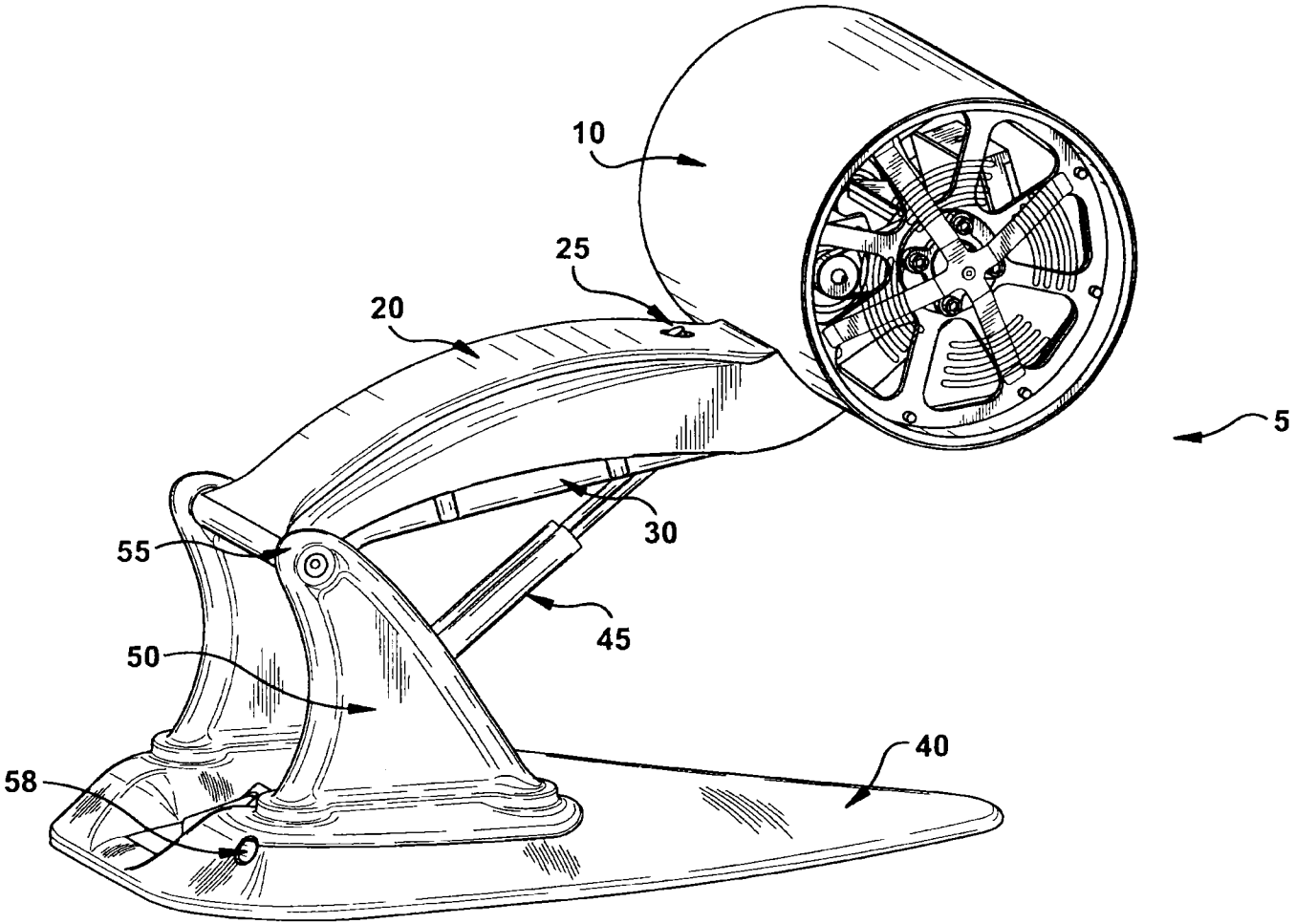
FIG. 1 illustrates a biomechanical stimulation device.

With reference to FIG. 1, an embodiment of a biomechanical stimulator 5 is provided. The biomechanical stimulator device 5 includes a drum 10 attached to an upper arm 20. The drum 10 provides a biomechanical stimulation motion, such as an orbital translation motion. The drum 10 may comprise a cylindrical unit, or other shape, that contains a drive motor. The drum 10 is constrained to carry out rigid body motion, without appreciable rotation, such as by translating through a defined circular or elliptical orbit.

The upper arm 20 is pivotally attached by pivot interface bearings 55 to a pair of upright arm supports 50 that are attached to the base 40. The position of the drum 10 may be adjusted by pivoting the arm 20 with respect to the base 40 to a desired position. For example, the upper arm 20 assembly may house a pivot release button 25. When activated, the release button 25 may cause the arm 20 to release a clamping system of a pair of extension struts 45. Releasing the extension struts 45 allows the drum 10 to pivot with respect to the arm supports 50 and be set at any desired position along the travel of the arm 20. In an embodiment, the arm may travel up to 80 degrees. The 80 degrees of travel may allow the arm 20 to be positioned from a near horizontal position to a near vertical position, thus allowing for a comfortable position of the drum 10 for various body parts to be selected. The extension strut or struts 45 provide an upward force to push the drum 10 upward at a dampened velocity, thereby affording the user an easier position adjustment. The struts 45 may comprise modular locking gas springs. Once the upper arm 20 is in the desired position, the clamping system may reengage to prevent the arm 20 from moving.

In an embodiment, a locking and unlocking mechanism is configured to release all locking gas springs at once. The locking and unlocking mechanism employs a pair of serially linked slider crank linkages to control the gas springs. This arrangement provides the necessary mechanical advantage, which can be adjusted by changing the position of a single fulcrum.

The upper arm may be composed of hollow shells with thin-walled, generally C-shaped cross-sections. In an embodiment, the cross sections may be economically manufactured as aluminum castings that are joined together with fasteners to transfer shear load between the shells at their mating boundary and create dramatically higher torsional and bending stiffness in the resulting structure of the arm 20.

An electronic housing 30 may attach to the upper arm 20. The electronic housing 30 provides a stiffening support for the upper arm 20. Further, the lower arm-electronic housing 30 may house electrical components and electronic controls for the biomechanical stimulator 5. In one embodiment, the arm is composed of conductive material or a conductively coated material. An electrically conductive gasket may be disposed between the structural components of the arm 20 to create a Faraday cage and effectively shield the internal electronics from creating or being affected by electro-magnetic interference (EMI). Further, the arm 20 may include thermally conductive structural components to act as a heat sink and thus reduce the size, cost, temperature, and failure rates of the electronics in the electronic housing 30.

Figure 2A:
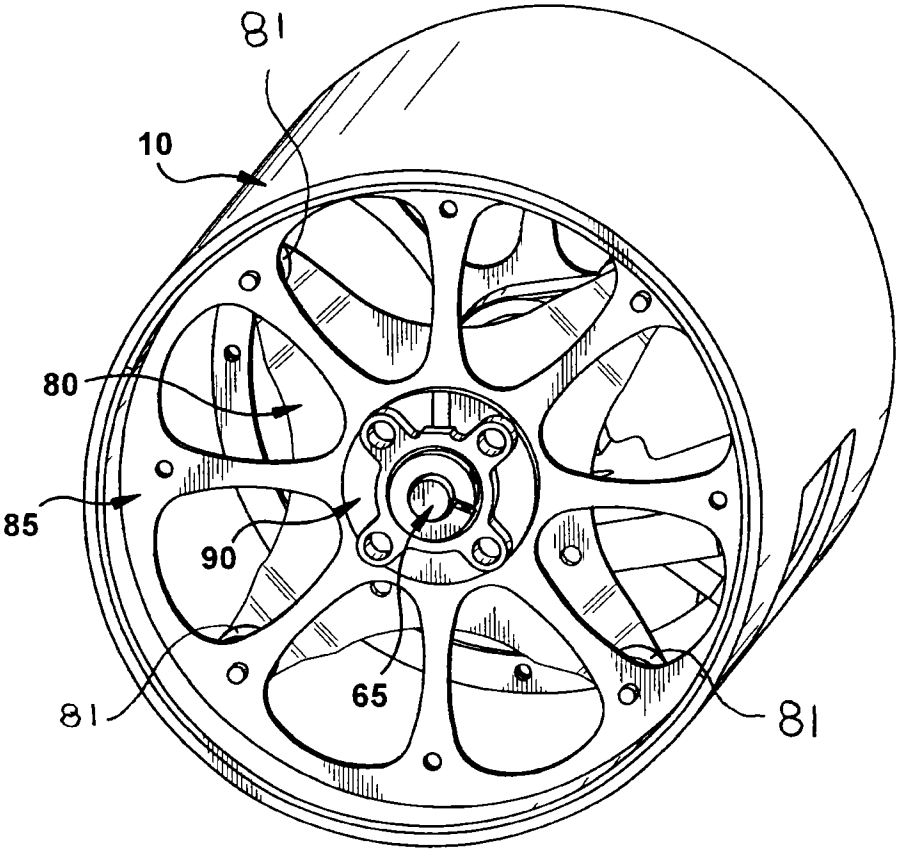
FIG. 2A illustrates a right view of a rotational motion drum.
Figure 2B:
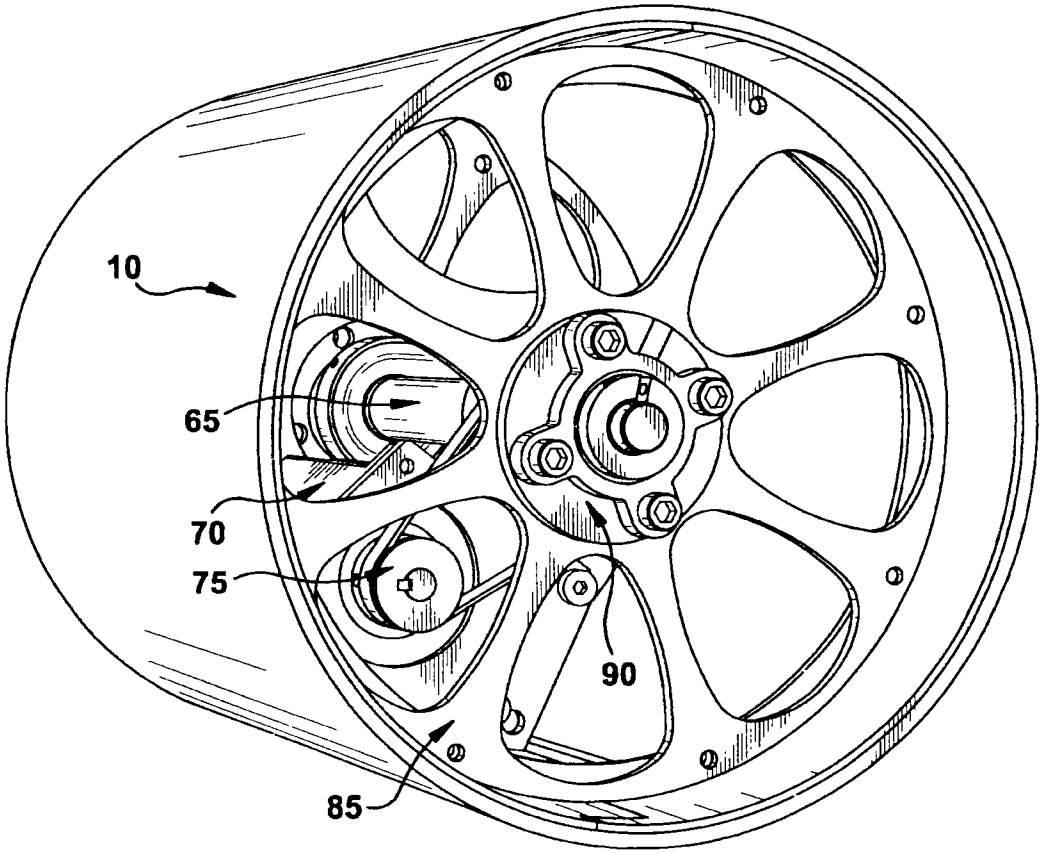
FIG. 2B illustrates a left view of a rotational motion drum.
Figure 3:
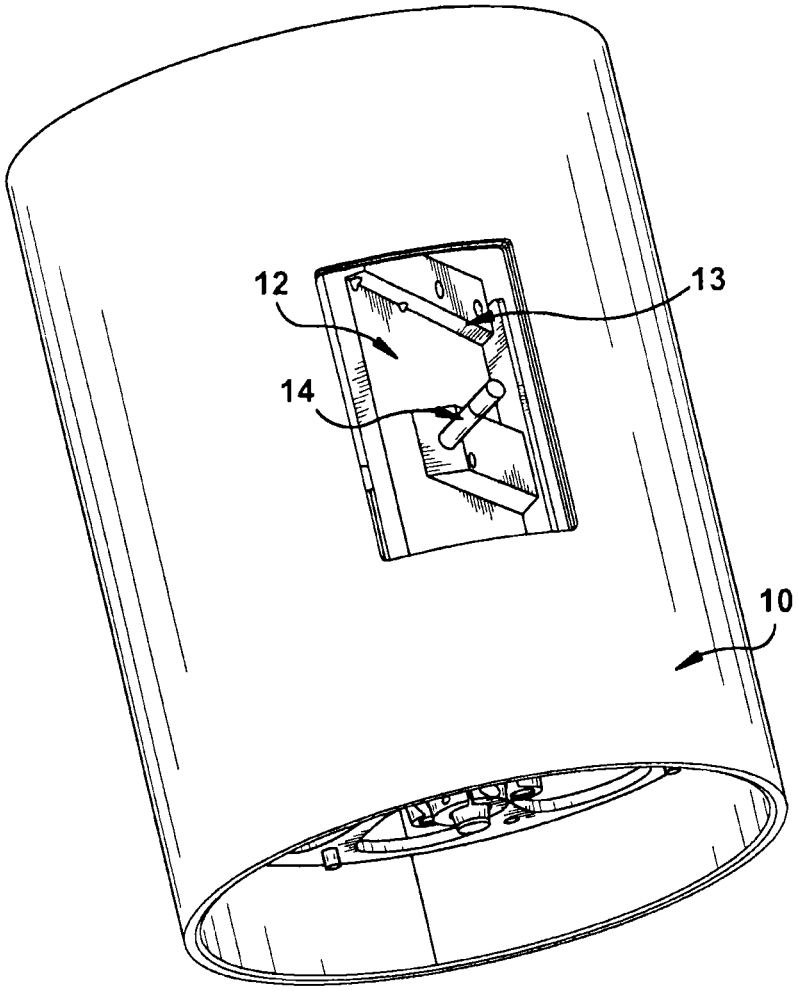
FIG. 3 illustrates a drum assembly having a single mounting attachment and slidable surface.
Figure 4:
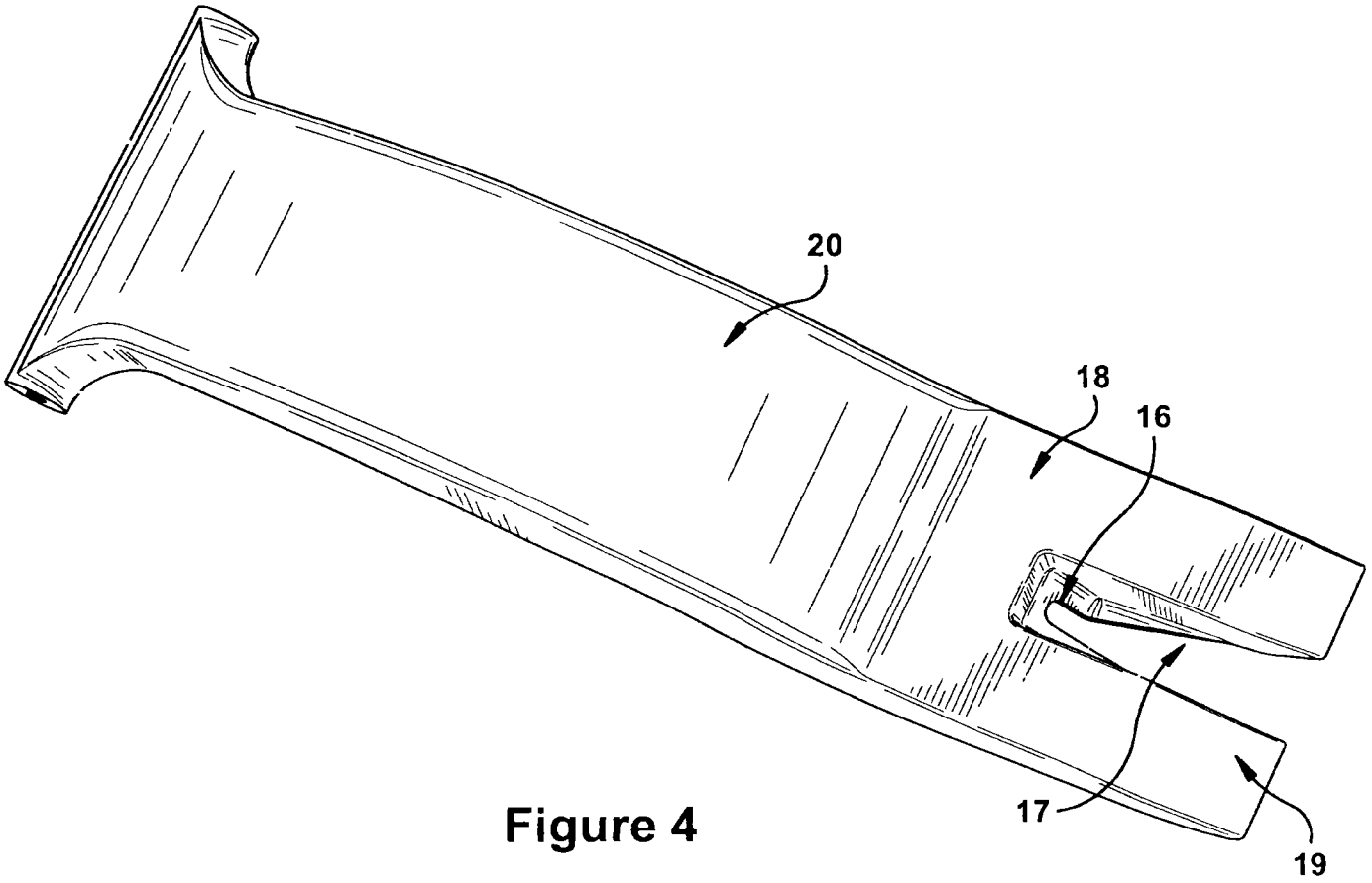
FIG. 4 illustrates an upper arm assembly.

The biomechanical stimulator 5 includes a drum 10, as shown in FIGS. 2A and 2B. The drum may be configured to translate in an orbiting motion with respect to the upper arm 20. In one embodiment, the drum 10 may comprise a cylindrically shaped body and components to facilitate motion of the drum 10 housed inside the body of the drum 10. In general, the drum 10 may be any ergonomic shape that readily affords transfer of biomechanical stimulation to a user's body parts. The drum 10 may be manufactured from a metal, plastic, composite, or other material conventionally used for such components. The outside of the drum 10 may be coated with a layer made from a soft material such as foam rubber.

The drum 10 may be connected to the motor 70 by means of a ball bearing in such a manner that, during operation, the cylindrical basic body carries out a circular or elliptical movement about an axis that differs from the central axis of the drum cylinder and undergoes parallel displacement in the process. This movement has been described in the pending European patent applications No. 03028004.4 and No. 04000668.6, each of which are hereby incorporated by reference in their entirety.

The drum 10 thus is driven to translate in a circular or elliptical orbit. The orbit may be uniform and consistently repeated instead of random. It has been shown that biomechanical muscle stimulation can be carried out in a considerably more effective manner in this way than if it is carried out using random and therefore non-uniform movements. The elliptical or circular movements of the drum 10 provide not only a vertical force but also a tensile force that can act in an essentially parallel manner on a device or body part placed on the drum 10. This results in considerably improved biomechanical stimulation of that part of the body which is situated on the drum.

In an embodiment, the movement of the drum may be translation in a circular orbit about an axis without appreciable rotation. As used herein, circular movement is understood as meaning a movement that differs from an ideal circular movement by no more than 5%.

A drum weldment 85 may be positioned between the inner surface of the drum 10 and drum-shaft bearings 90. The drum-shaft bearings 90 may be configured to hold a shaft within the drum 10. The bearings 90 may include non-contacting seals and low friction lubrication that connect the drum-shaft to the non-moving portion of the drum 10 to measurably reduce power consumption. The drum weldment 85 connects the drum 10 to a rotational drive system, further illustrated in FIG. 6 and described in further detail below. The rotational drive may consist of a motor 70, a pulley system 75 and an eccentric drive shaft 65 positioned within the drum 10. The eccentric drive shaft 65 is attached to an anti-rotation plate or non-orbiting drum base 80 and drum-shaft support bearing. The eccentric shaft 65 provides the amplitude of the elliptical stimulation motion.

The anti-rotation mechanism employs a plurality of rubber elements 81 or sandwich mounts to appreciably limit rotation of the drum 10, while allowing translation of the drum 10 through the prescribed orbit characteristic of biomechanical stimulation. One end of each rubber element 81 is attached to the non-orbiting drum base while the other end is attached to the orbiting portion of the drum 10. Other embodiments of an anti-rotation mechanism are also possible.

The drum 10 may connect to the arm 10 by way of a single attachment system. For example, the single attachment system includes a slidable mounting surface of a drum base 12 of the drum 10 configured to mate with a similar slidable mounting surface 18 of the arm 20. An alignment method may be provided to aid the docking and attachment of the drum 10 to the arm 20. The drum alignment guides 13 direct the forks 19 of the arm 20 into the slidable mounting surface of the drum base 12 of the drum 10. An attachment bolt 14 of the drum may slide into the arm channel guide 17 of the arm 20 to provide an inner alignment. The attachment bolt 14 rests in an attachment bracket 16 of the arm, and a nut or fastener may be screwed onto the attachment bolt 14 to secure the drum 10 to the arm 20. The drum 10 may be easily removed from the arm 20 or base by releasing the nut or fastener and disconnecting a single quick-disconnect plug. The quick-disconnect plug may be a blind-mate connector with a plurality of electrical contacts that automatically mates when the drum 10 is secured to the arm 20 or base 40 and provides electrical power and control signals to the motor. Other drums having different characteristics, such as shape, size, or eccentricity, may be interchanged with the drum 10 to increase the functionality, serviceability, and portability of the biomechanical stimulator 5.

Figure 5:
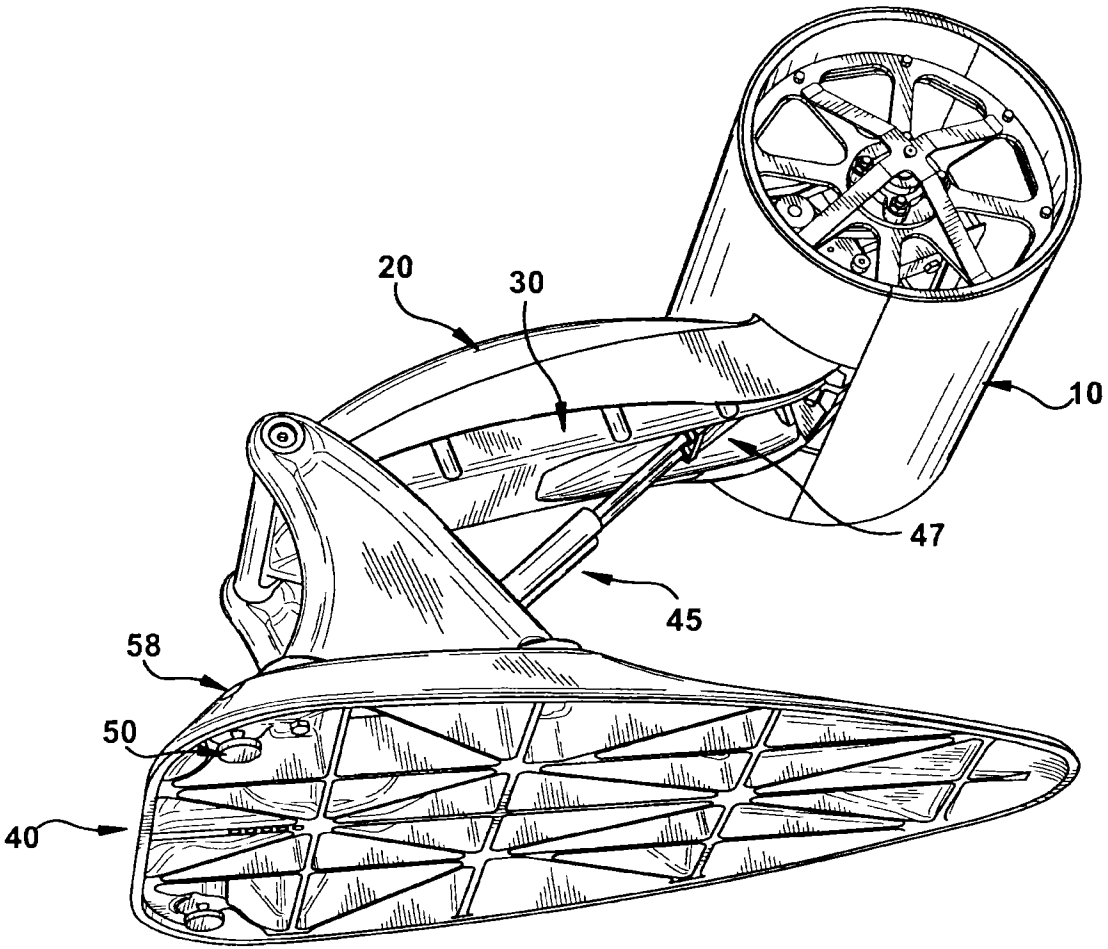
FIG. 5 illustrates an underside view of a biomechanical stimulation device having an extendable strut.

The biomechanical stimulator 5 may include a base 40, as shown in FIG. 5. The base 40 provides a leveling system to level and stabilize the biomechanical stimulator 5 on uneven floors and surfaces. The leveling system may consist of a top adjustable leveling screws 58 and leveling feet 59.

The biomechanical stimulator 5 may be positioned to interface a body part with the drum 10. As an example of this interface for lower leg muscles, such as a calf muscle, a user may sit in a chair with their legs draped over the drum 10 for stimulation therapy. Another example of this interface might be where the drum 10 is raised to a 45 degree elevation allowing the user to stand leaning a quadricep muscle against the drum 10. To assist in positioning the drum 10, the extendable strut or struts 45 provide an upward lifting force capable of lifting the arm 20 and drum 10 automatically when the pivot activation button 25 is depressed. The depression of this activation button 25 simultaneously depresses the mechanical release linkage 47 of one or more extendable struts 45, thus allowing for pivotal adjustment of the arm 20 and drum 10 to an upward position. Alternatively, upon depression of pivot activation button 25, the arm 20 and drum 10 can be positioned to a lower position by applying a slight added downward force to the drum 10.

Figure 6:
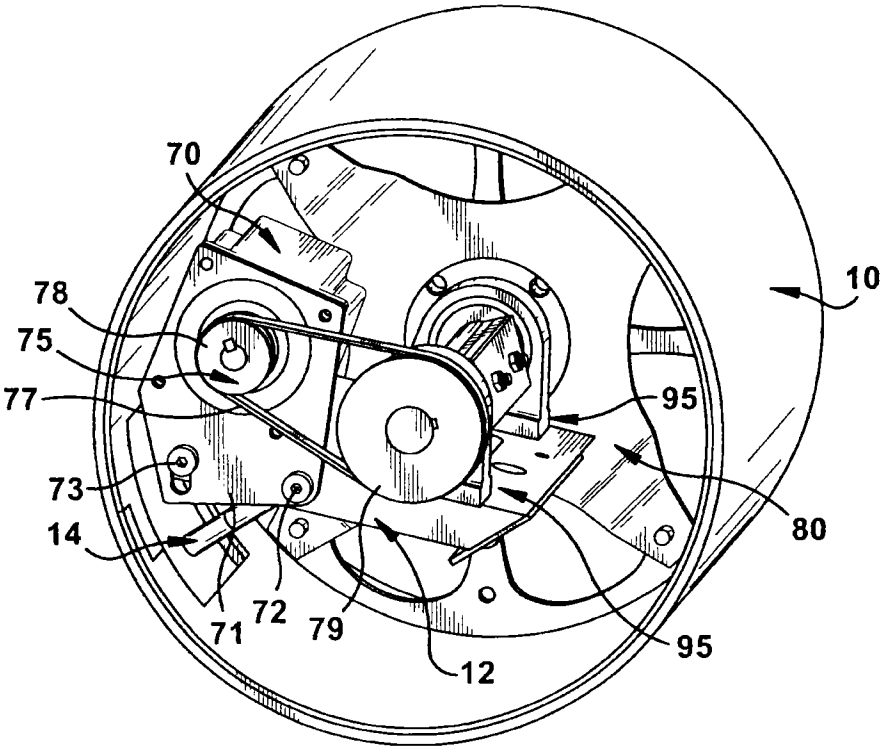
FIG. 6 illustrates a cutaway view of a rotational motion drum showing the drive system.
Figure 7:
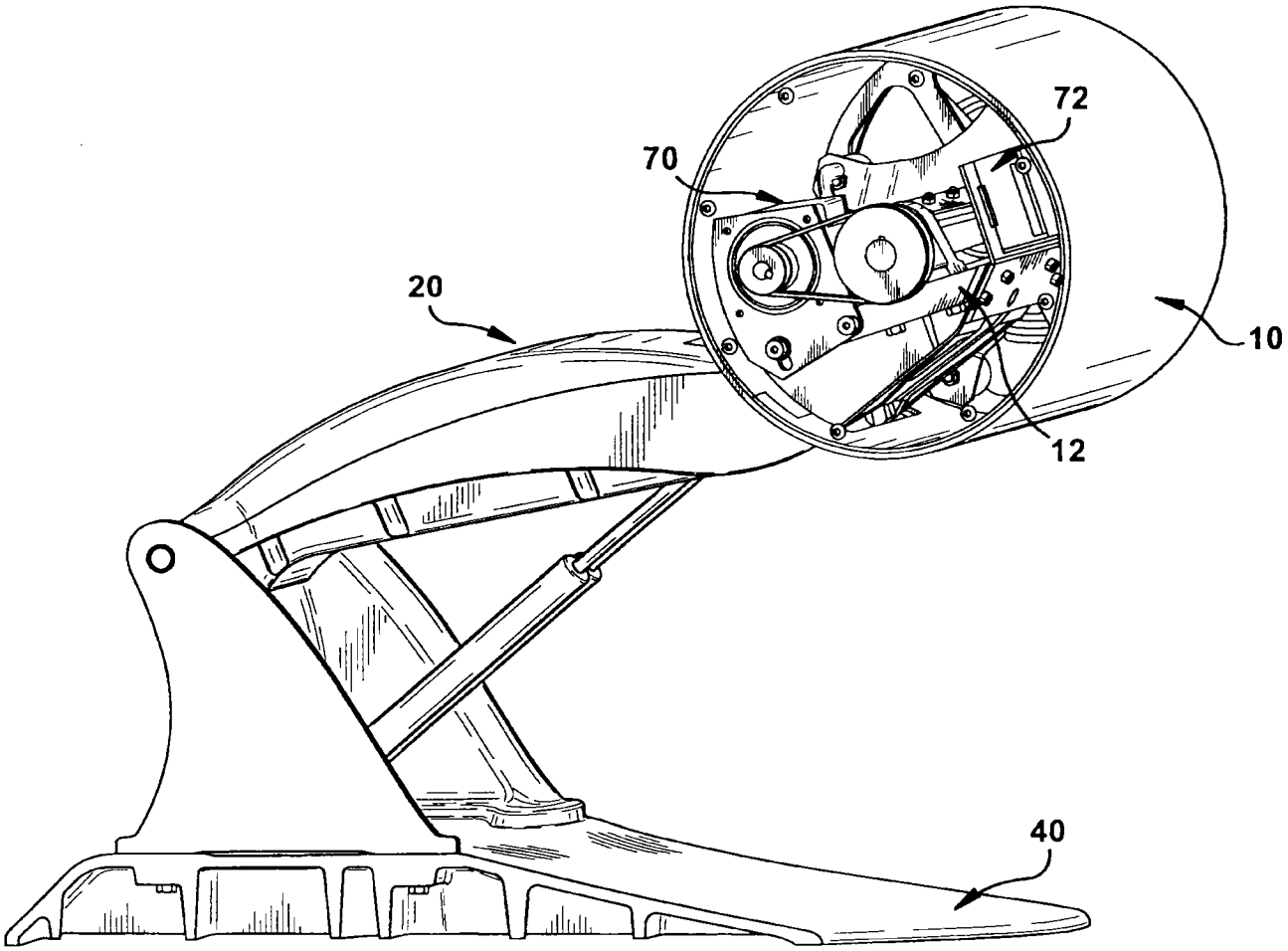
FIG. 7 illustrates a cutaway view of a rotational motion drum of a biomechanical stimulation device showing a mounting method.

A motor 70 housed within the drum 10 generates rotational motion that is used to rotate the eccentric shaft 65 and translate the drum 10. The rotational motion may be converted to elliptical motion for stimulation. As best illustrated in FIGS. 6 and 7, the motor 70 is coupled to the eccentric drive shaft 65 by a pulley system 75. The motor 70 may be an electric motor, or any other type of motor 70 or mechanical drive known in the art. The motor 70 may be a 3-phase AC motor or permanent magnet DC motor to reduce the number of conductors needed to power and control the motor 70. The motor 70 may be ventilated to appreciably reduce operating temperature of motor 70. The pulley system 75 includes a belt 77 that couples a first pulley wheel 78 to a second pulley wheel 79. It will be appreciated, however, that other components, such as a gear train or a direct drive, may be used in place of the pulley system 75. The motor 70 drives the first pulley wheel 78 to transfer torque from the motor 70 to the second pulley wheel 79 via the belt 77. The second pulley wheel 79 is connected to the eccentric drive shaft 65 that rotates in response to rotational movement of the motor 70.

The motor 70 may be mounted to a rotatable mounting plate 71 that is rotatably connected to the drum 10. The mounting plate may be connected by a first bolt 72 and be rotatable about the first bolt. A second bolt 73 may be inserted to fix the motor 70 in position. The fixed position may be configured as a position where tension is applied to the belt 77. Moreover, both bolts may be removed to extract the mounting plate 71 and the motor 70 for replacement or servicing.

The eccentric drive shaft 65 is support on the non-moving drum base 12 by two bearings 95. The bearings may be pillow block bearing or any other type of bearings known in the art. The engagement between the bearings 95 and the eccentric drive shaft 65 may be configured to create elliptical stimulation motion of the drum 10. The eccentric drive shaft 65 may create the amplitude of the elliptical stimulation motion. For example, the eccentric drive shaft 65 may create 2, 3, or 4 millimeters elliptical amplitude. However, it will be appreciated that the eccentric drive shaft 65 may be configured to achieve any amplitude.

Figure 10:
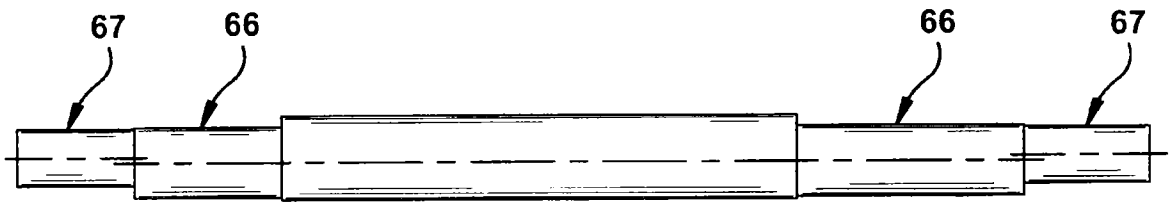
FIG. 10 illustrates a side view of an eccentric shaft.
Figure 11:
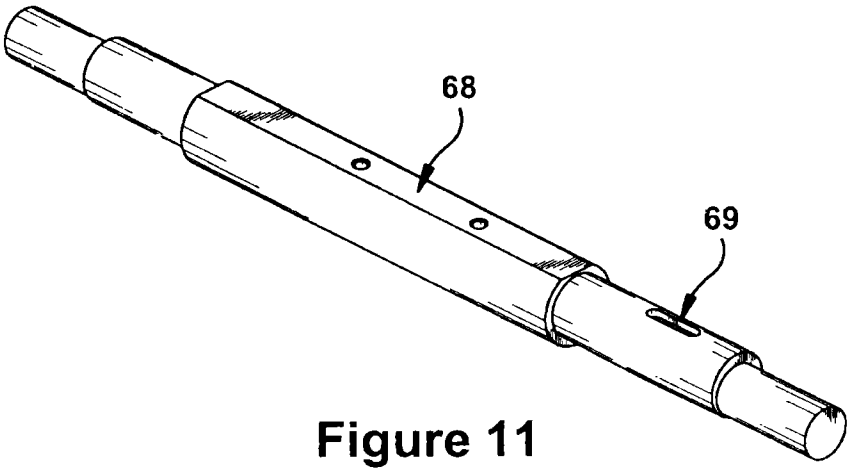
FIG. 11 illustrates a perspective view of an eccentric shaft.
Figure 12:
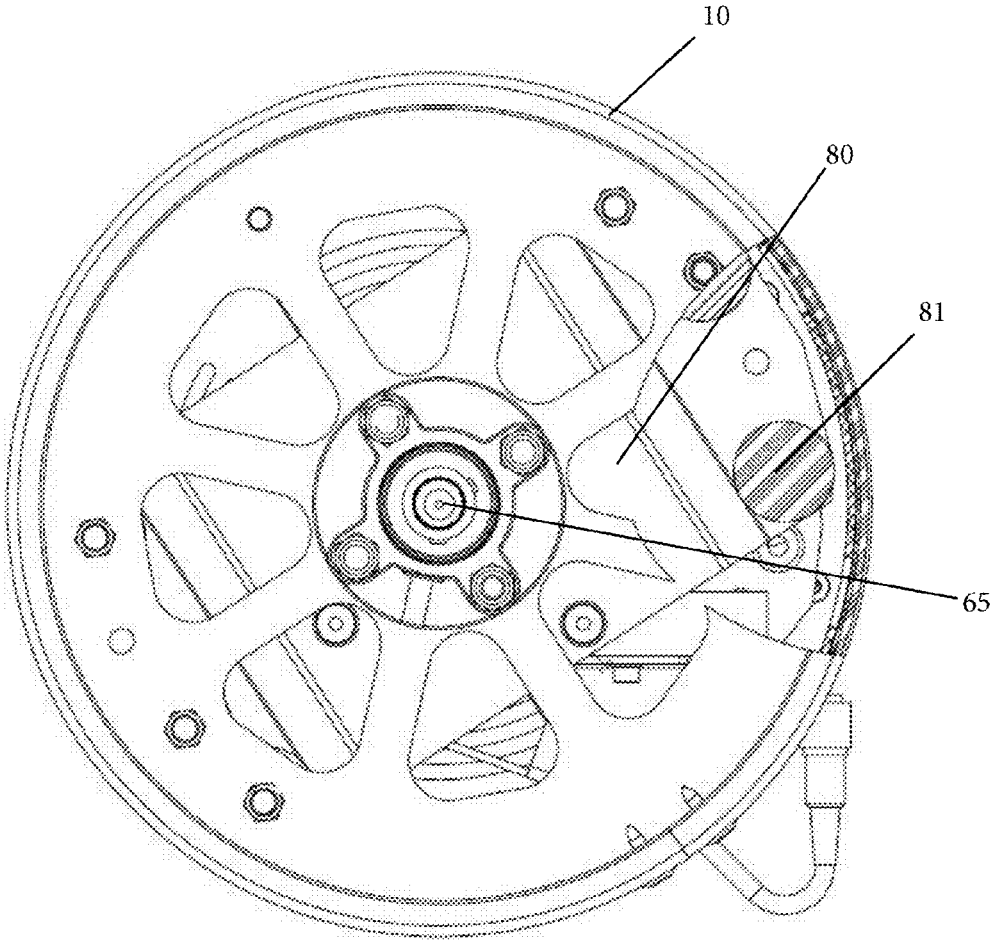
FIG. 12 illustrates a rotational drum having a plurality or rubber mounts connecting a drum to a non-orbiting base of the drum.

As illustrated in FIGS. 10 and 11, a pair of inner journals 66 may be positioned to support the eccentric drive shaft 65 on an axis concentric to the diameter of the drive shaft 65. Further, a pair of outer journals 77 may be positioned parallel to, but offset from, the concentric axis by an eccentric distance. The eccentric journal radius may be smaller than the concentric journal radius by an amount at least as big as the eccentric distance. An indexing feature such as a flat 68 or keyway 69 may be configured to index rotational position of shaft during fabrication to ensure that the eccentric journals are on a common axis. Counter-balance weights may be mounted on the side of the shaft. For example, the counter balance weights may be mounted to be diametrically opposed to the direction of the eccentric distance. Further, an additional concentric axis may be configured for attaching a pulley or gear in order to transfer torque from the motor to this shaft.

The eccentric drive shaft 65 may include adjustable counter-balance masses to allow for two-plane balance of the vibration drum. The counter-balance masses minimize load on bearings and minimize vibration transmitted to the arm 20 and base 40 Further, the counter-balance masses, which can be adjusted, allow for precise balance to be maintained even if auxiliary attachments are added to the drum 10.

Figure 13:
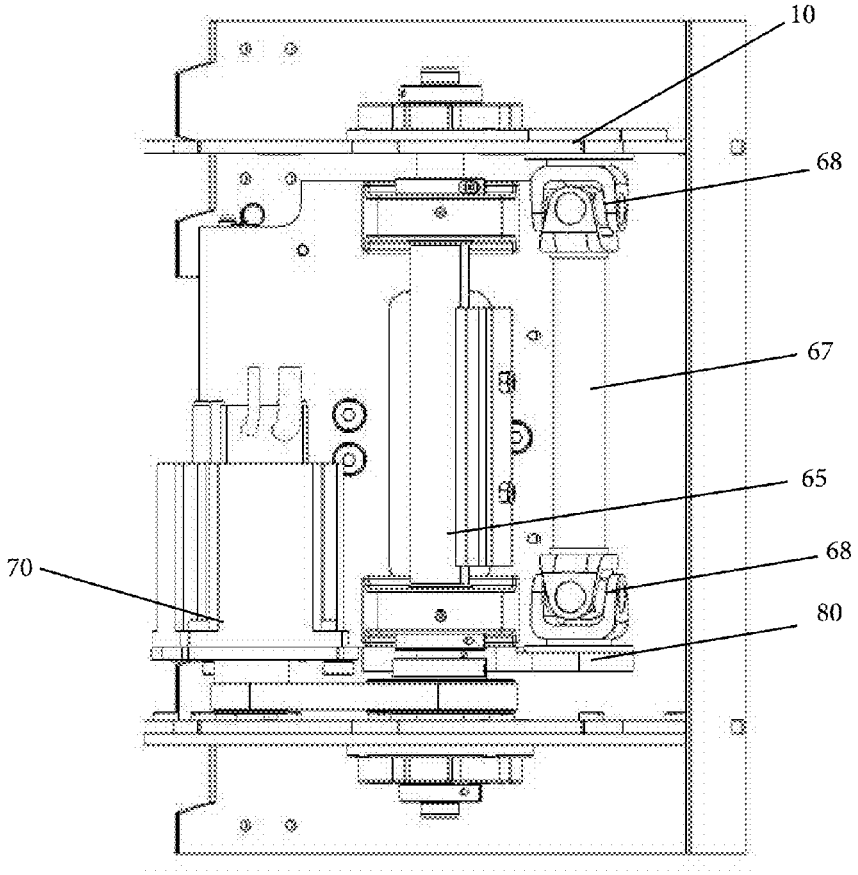
FIG. 13 illustrates a rotational drum having a drive shaft with flexible end couplings connecting a drum to a non-orbiting base of the drum.

In an embodiment as illustrated by FIG. 13, a non-rotating drive shaft 67 is positioned approximately parallel to the eccentric shaft 65. The first end of the non-rotating shaft may be coupled to a moving portion of the drum 10 and the second end coupled to a non-moving portion of the drum base 12 by way of flexible couplings 68 such as a universal joint, a constant velocity joint, a bellows coupling, or similar device that is rotationally stiff about the axis of the drive shaft but flexible in bending at each coupling thus allowing the moving part of the drum 10 to translate in a plane perpendicular to the axis of the eccentric shaft 65 but not rotate.

Figure 14:
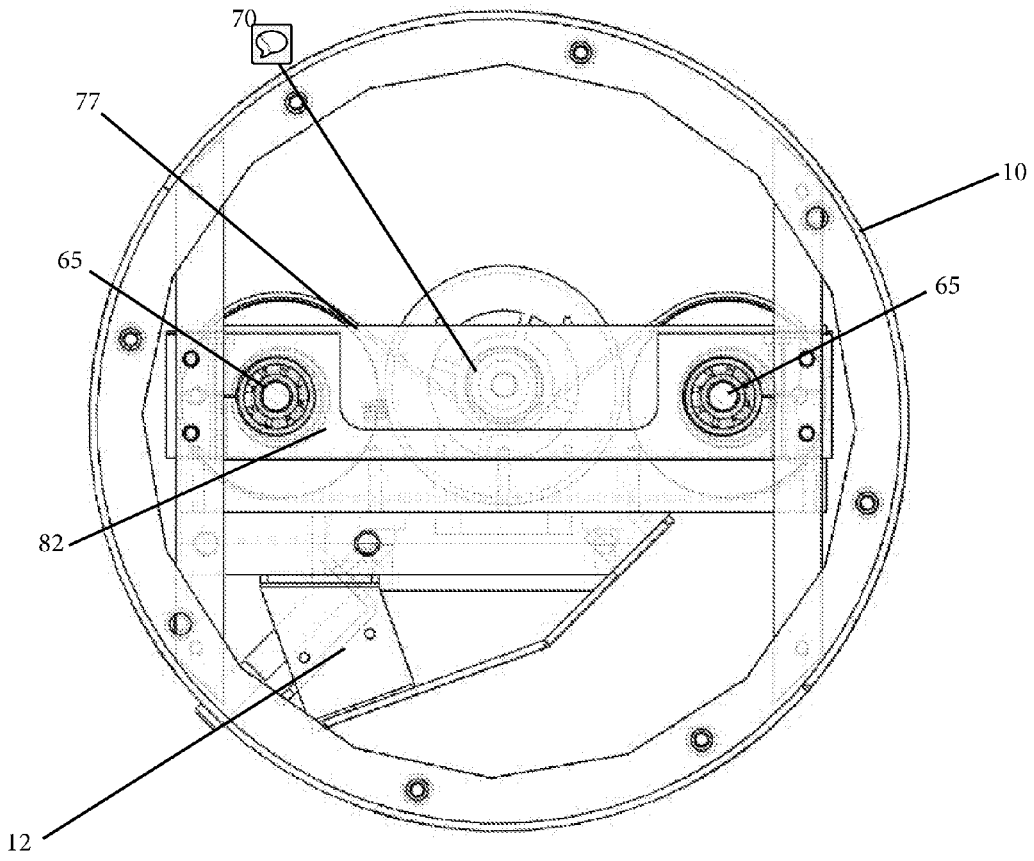
FIG. 14 illustrates a rotational drum having a parallel pair of eccentric shafts driven to rotate in the same direction and configured into a parallelogram linkage connecting a drum to a non-orbiting base of the drum.

In another embodiment, as illustrated by FIG. 14, the drum 10 is mounted to a non-moving base 12 by way of bearings and two identical parallel eccentric shafts 65 which are driven in the same direction, effectively creating a 4-bar parallelogram linkage 82. Both parallel eccentric shafts 65 must be driven to prevent the linkage from inverting when the four points of the linkage are all aligned.

Figure 15:
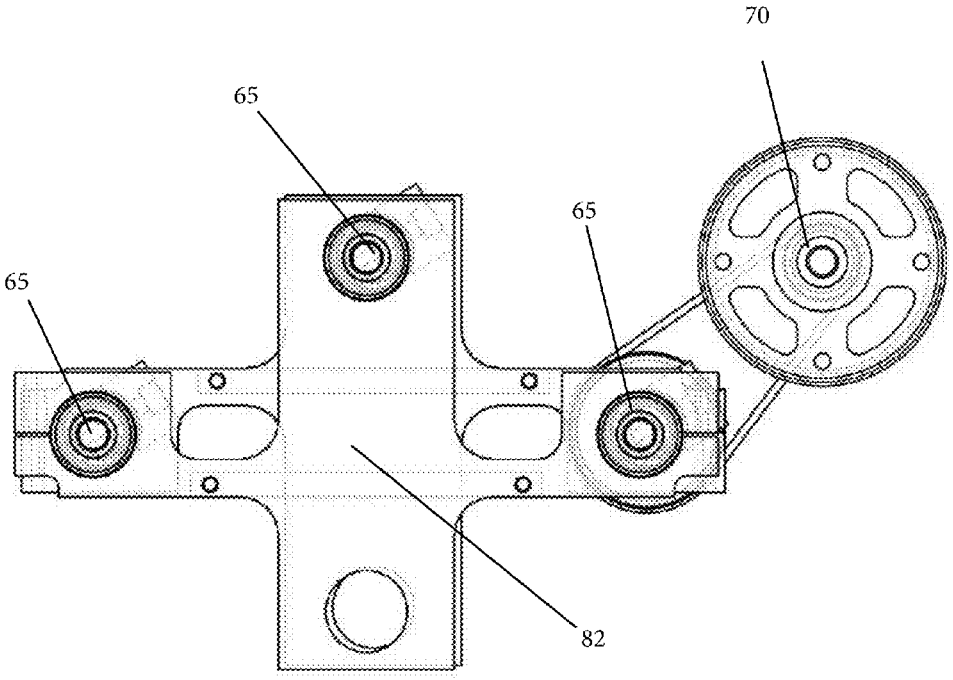
FIG. 15 illustrates a rotational drum having three parallel eccentric shafts not all in a common plane and configured into a set of parallelogram linkages connecting a drum to a non-orbiting base of the drum.

In an alternative embodiment as illustrated by FIG. 15, the drum 10 is mounted to a non-moving base 12 by way of bearings and three or more identical parallel eccentric shafts 65. The identical parallel eccentric shafts 65 are positioned such that their axes are not located in a common plane. At lease one of the shafts is driven. This configuration effectively creates three or more 4-bar parallelogram linkages 82 such that at any instance at least one of the parallelogram linkages does not have all its pivot points collapsed into a line.

Motor speed may be controlled by an electrically wired or wireless hand or foot controller 100 or by a computer. The hand controller 100 may provide additional motor control signals, such as a speed control signal. It will be appreciated, however, that the motor 70 may be controlled by means other than the hand controller 100.

Figure 8:
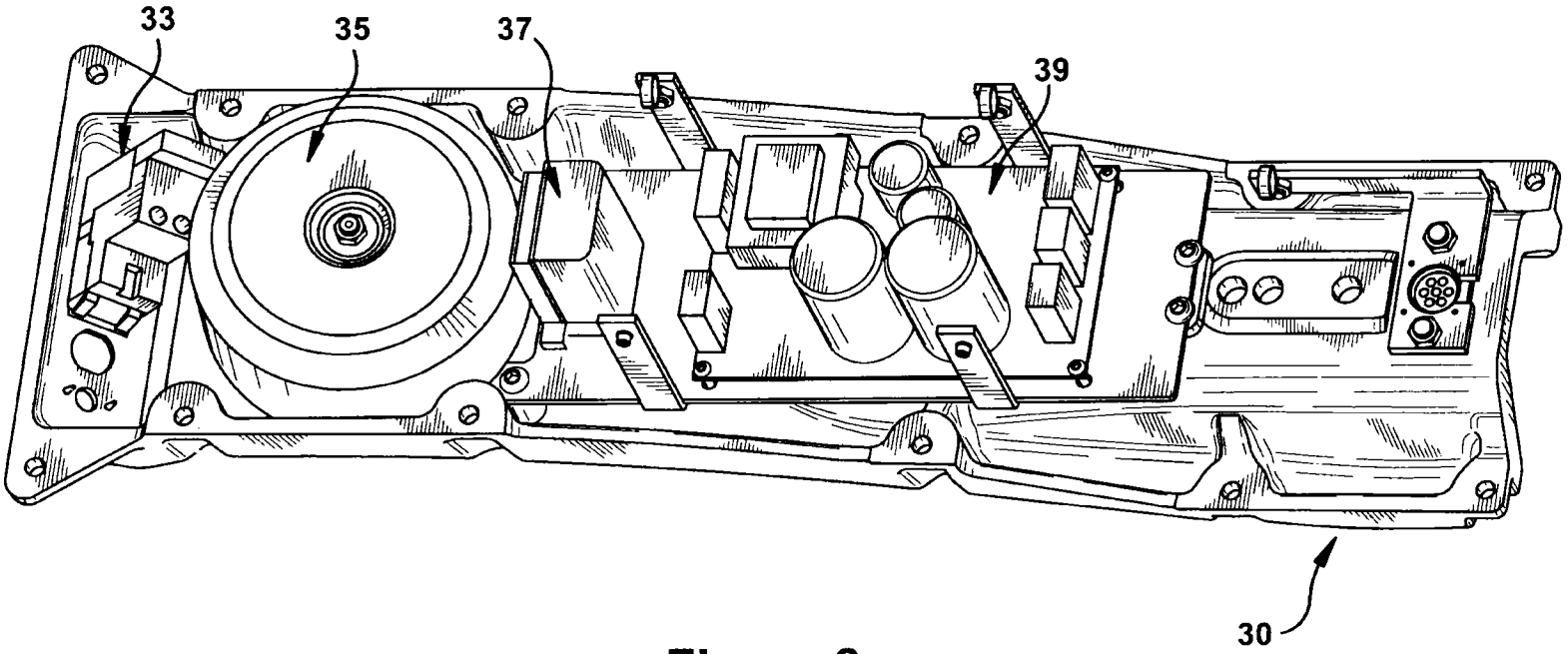
FIG. 8 illustrates the electrical and electronic components of a Lower Arm Assembly.

The motion controller 37, shown in FIG. 8, may be a programmable device. For example, the motion controller 37 may retain a firmware code for operating the biomechanical stimulator 5 in a memory. A plurality of speed versus time profiles for controlling the biomechanical stimulator 5 may be pre-programmed into the memory. The lower arm 30 may house additional electrical and electronic components used to control the stimulation motion of the biomechanical stimulator 5. A power entry module 33 may provide for the interface attachment of an AC voltage plug and line cord to a typical outlet, for powering the biomechanical stimulator 5. This power entry module 33 further may house an on-off switch, fusing, voltage and frequency selection adjustment, an EMI-RFI filtering module, and other electrical and electronic components.

In an embodiment, the biomechanical stimulator 5 can be powered electrical power of multiple voltages typical throughout the world.

Figure 9:
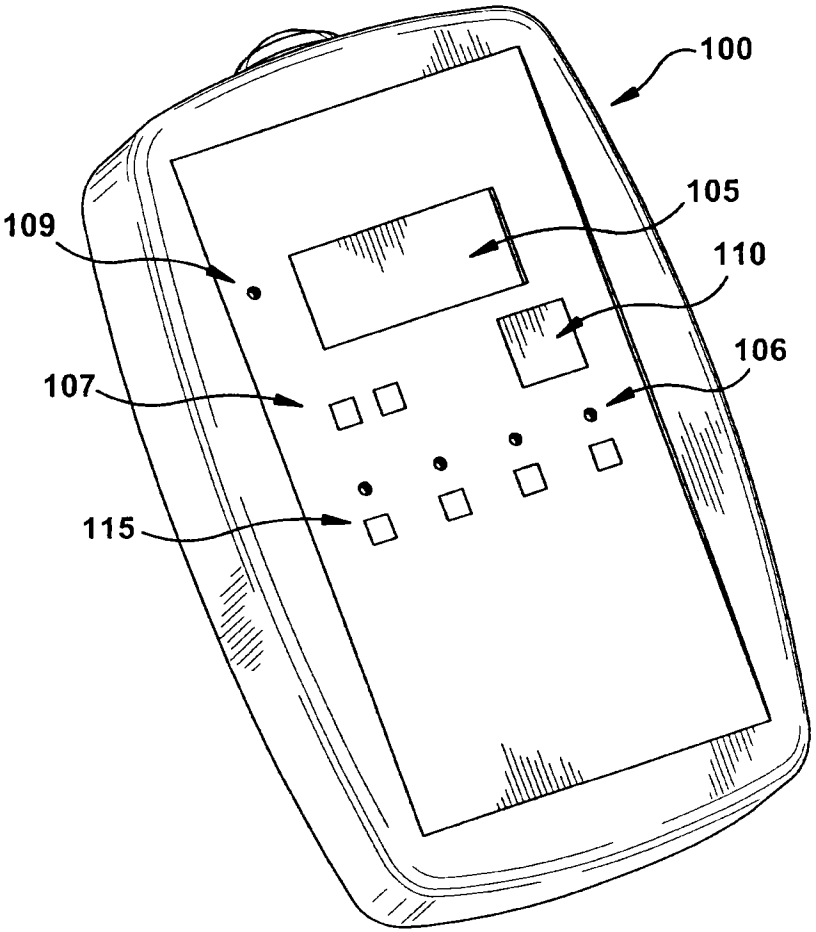
FIG. 9 illustrates a hand controller user interface control.

Referring to FIG. 9, the hand controller 100 may be used to interface, control, and view operating parameters of the biomechanical stimulator 5. The biomechanical stimulator 5 setup and current settings may be viewed by referencing the hand controller 100 displays. For example, the hand controller 100 may include display viewing areas, including a power indicator display 109, a speed display 105, and a runtime display 106 to provide the operating time for a stimulation therapy session. The time may be regulated by start/stop switches by either a start/stop switch 110 on the hand controller 100 or a foot start/stop switch 112.

In an embodiment, the hand controller 100 may include a rotating knob to control the speeds of the biomechanical stimulator by way of a potentiometer or encoder. The hand controller 100 may further include a momentary switch button which starts and stops biomechanical stimulator 5. A 6-pin connector may provide the hand controller with supply voltage for the potentiometer, and return a speed control voltage, and an on/off control signal to the motor drive. The hand controller 100 may further include a communication port to communicate with devices such as a computer, PC, laptop, touch screen or PLC.

In an embodiment, the speed and frequency adjust switches 107 may select speeds or frequency digitally from 5 Hertz to 36 Hertz. The user interface may allow a user to select any variety of pre-programmed, including on/off cycles; fixed or varying speed; fixed and varying time durations.

In use, the biomechanical stimulator 5 may be placed in a warm-up cycle to allow for 6 on-off cycles by the activating of the start/stop switch 110 or the foot control start/stop switch 112. The stimulation speed or frequency of the drum 10 may be adjusted using the speed-frequency switches 107. A body part may then be positioned in contact with the drum 10. The biomechanical stimulator 5 may begins the stimulation motion of the drum 10 once the start/stop switch 110 or the foot control start/stop switch 112 is activated. The biomechanical stimulator may continue its operation for a time period, such as 30 seconds, then pause for a time period, such as 6 seconds, to allowing for repositioning of another body part in direct contact with the drum 10 before restarting. This cycle will continue until a set number of cycles, such as 6 cycles, have been completed.

The invention as described here will obviously upon the reading and understanding of this specification enlighten others to consider alterations and modifications. It is intended to include all such modifications and alterations insofar as they come within the scope of the appended claims or the equivalent thereof.

We claim:

1. A biomechanical stimulation device comprising:
a base;
an arm connected to said base;
a drum connected to said arm;
a parallel pair of eccentric shafts; and
a motor connected to said drum, said motor configured to drive said drum in an orbital translation motion about said parallel pair of eccentric shafts, each having an offset bearing journal;
wherein said parallel pair of eccentric shafts, both of which are driven to rotate in a same direction by said motor and configured into a parallelogram linkage connecting said drum to a drum base that is non-moving relative to said arm.

2. The biomechanical stimulation device of claim 1, wherein said motor is disposed within said drum.

3. The biomechanical stimulation device of claim 1, wherein said orbital translation motion comprises uniform elliptical movements of said drum.

4. The biomechanical stimulation device of claim 1, wherein said drum is removably connected to said arm.

5. The biomechanical stimulation device of claim 4, wherein said drum is removably connected to said arm at a single attachment comprising a bolt and a nut.

6. The biomechanical stimulation device of claim 4, wherein said drum include an alignment guide at said single attachment configured to align with an end portion of said arm.

7. The biomechanical stimulation device of claim 1, wherein said arm is pivotally connected to said base.

8. The biomechanical stimulation device of claim 7 further comprising one or more struts connected to said arm and configured to assist in a pivotal positioning of said arm.

9. The biomechanical stimulation device of claim 8, wherein said one or more struts comprise gas springs.

10. The biomechanical stimulation device of claim 9, wherein said gas springs are lockable to maintain said arm in a set position.

11. The biomechanical stimulation device of claim 10 further comprising a release button configured to unlock said gas springs to allow said arm to be pivotally positioned.

12. The biomechanical stimulation device of claim 1 further comprising a plurality of adjustable feet connected to said base.

13. The biomechanical stimulation device of claim 1, wherein said motor is capable of driving said drum at a plurality of different speeds.

14. The biomechanical stimulation device of claim 1, wherein a speed of said motor is selectable based on input provided by a hand controller.

15. The biomechanical stimulation device of claim 14, wherein said hand controller configured to display the speed of said motor.

16. The biomechanical stimulation device of claim 14, wherein said hand controller communicates with said motor via wireless communication.

* * * * *